US012172686B2

(12) United States Patent
Tomida et al.

(10) Patent No.: US 12,172,686 B2
(45) Date of Patent: Dec. 24, 2024

(54) FORWARD MONITORING DEVICE AND FORWARD MONITORING METHOD

(71) Applicant: Mitsubishi Electric Corporation, Tokyo (JP)

(72) Inventors: Masashi Tomida, Tokyo (JP); Yukitoshi Inaba, Tokyo (JP); Koki Yoshimoto, Tokyo (JP); Emiko Kurata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 186 days.

(21) Appl. No.: 18/003,222

(22) PCT Filed: Jul. 1, 2020

(86) PCT No.: PCT/JP2020/025879
§ 371 (c)(1),
(2) Date: Dec. 23, 2022

(87) PCT Pub. No.: WO2022/003873
PCT Pub. Date: Jan. 6, 2022

(65) Prior Publication Data

US 2023/0249724 A1 Aug. 10, 2023

(51) Int. Cl.
*B61L 23/34* (2006.01)

(52) U.S. Cl.
CPC ..... *B61L 23/34* (2013.01)

(58) Field of Classification Search
CPC ..... B61L 23/34; B61L 23/041
(Continued)

(56) References Cited

U.S. PATENT DOCUMENTS 9,283,945 B1 * 3/2016 Kernwein ..... B60T 17/228
2022/0388555 A1 * 12/2022 Zhang ..... B60T 17/228

FOREIGN PATENT DOCUMENTS

EP 3177502 B1 6/2019
JP 09-226583 * 9/1997
(Continued)

OTHER PUBLICATIONS

Office Action dated Mar. 14, 2023, issued in the corresponding Indian Patent Application No. 202227075623, 6 pages.
(Continued)

*Primary Examiner* — Muhammad Shafi
(74) *Attorney, Agent, or Firm* — Buchanan Ingersoll & Rooney PC

(57) ABSTRACT

A forward monitoring device for a train includes: a storage unit storing map information representing location information and a track geometry of a track and brake performance information representing performance of a train brake system; a train information acquisition unit obtaining train location information and train speed information; a monitoring unit monitoring an upside of the track in the travel direction; an obstacle determination unit determining presence or absence of an obstacle on the track based on a monitoring result of the monitoring unit; a braking distance calculation unit calculating a train braking distance using the map, brake performance, train location, and train speed information, and a processing time from when the monitoring unit performs monitoring until determination on presence or absence of an obstacle; and a monitoring distance determination unit determining a monitoring distance based on the braking distance to set a monitoring range of the monitoring unit.

18 Claims, 11 Drawing Sheets

(58) Field of Classification Search
USPC ..... 701/302
See application file for complete search history.

(56) References Cited

FOREIGN PATENT DOCUMENTS

| | | | | | |
|---|---|---|---|---|---|
| JP | H09226583 | A | | 9/1997 | |
| JP | 2016-193669 | | * | 11/2016 | |
| JP | 2016193669 | A | | 11/2016 | |
| JP | 2019-181996 | | * | 10/2019 | |
| JP | 2019181996 | A | | 10/2019 | |
| WO | WO-2019155569 | A1 | * | 8/2019 | ..... B61L 23/041 |
| WO | WO-2021149211 | A1 | * | 7/2021 | ..... B61L 25/02 |
| WO | WO-2022009273 | A1 | * | 1/2022 | ..... B61L 23/00 |

OTHER PUBLICATIONS

International Search Report (PCT/ISA/210) with translation and Written Opinion (PCT/ISA/237) mailed on Sep. 24, 2020, by the Japan Patent Office as the International Searching Authority for International Application No. PCT/JP2020/025879. (8 pages).

* cited by examiner

FORWARD MONITORING DEVICE AND FORWARD MONITORING METHOD

FIELD

The present disclosure relates to a forward monitoring device and a forward monitoring method each for monitoring an area in the travel direction of a train.

BACKGROUND

In the past, there has been a conventional practice in which a train monitors an upside of a railway track in a travel direction to detect some obstacle. In general, a monitoring device used on a train to detect an obstacle is unable to monitor the entire area in the travel direction of the train with the same accuracy, so that a resolution of a detection result and the like can vary depending on a distance. For this reason, the train is adapted to set a target scope for monitoring in the travel direction. Patent Literature 1 discloses a technique in which a forward monitoring device sets a monitoring area ahead of a train in accordance with a braking distance of the train. The forward monitoring device described in Patent Literature 1 detects a distant obstacle without unnecessary increase of a monitoring range, and at the same time, avoids an increase in size and rise in cost of the device, by setting a monitoring area in accordance with the braking distance of the train.

CITATION LIST

Patent Literature

Patent Literature 1: Japanese Patent Application Laid-open No. 2019-181996 (JP2019181996(A))

SUMMARY

Technical Problem

The forward monitoring device described in Patent Literature 1 calculates a braking distance in consideration of route information, a train speed, a brake performance, and/or the like, but not taking into account a processing time until a brake command is actually outputted from determination that there is an obstacle in the monitoring area, i.e., detection of an obstacle, based on an image captured by an imaging device. The train is supposed to run even during this processing time. This has presented a problem in that the braking distance calculated by the forward monitoring device described in Patent Literature 1 has low accuracy with respect to a braking distance from actual capture of the image until the train is stopped. Low accuracy of the braking distance calculated by the forward monitoring device described in Patent Literature 1 causes, in turn, initially-desired accuracy in detection of an obstacle in the monitoring area to be lowered.

The present disclosure has been made in view of the foregoing, and it is an object of the present disclosure to provide a forward monitoring device capable of improving accuracy of detection of an obstacle in a desired monitoring scope.

Solution to Problem

In order to solve the above-mentioned problems and achieve the object, the present disclosure provides a forward monitoring device to be installed on a train, the forward monitoring device comprising: a storage unit to store map information and brake performance information, the map information representing location information and a track geometry of a track on which the train is to run, the brake performance information representing performance of a brake system installed on the train; a train information acquisition unit to acquire train location information and train speed information of the train; a monitoring unit to monitor an upside of the track in a travel direction of the train; an obstacle determination unit to determine presence or absence of an obstacle on the track based on a monitoring result of the monitoring unit; a braking distance calculation unit to calculate a braking distance of the train using the map information, the brake performance information, the train location information, the train speed information, and a processing time from when the monitoring unit performs monitoring until the obstacle determination unit determines presence or absence of an obstacle; and a monitoring distance determination unit to determine a monitoring distance based on the braking distance to set a monitoring range of the monitoring unit.

Advantageous Effects of Invention

According to the present disclosure, an advantageous effect is achieved in that a forward monitoring device can improve accuracy of detection of an obstacle in a desired monitoring range.

DESCRIPTION OF EMBODIMENTS

A forward monitoring device and a forward monitoring method according to embodiments of the present disclosure will be described in detail below with reference to the drawings.

First Embodiment

Figure 1:
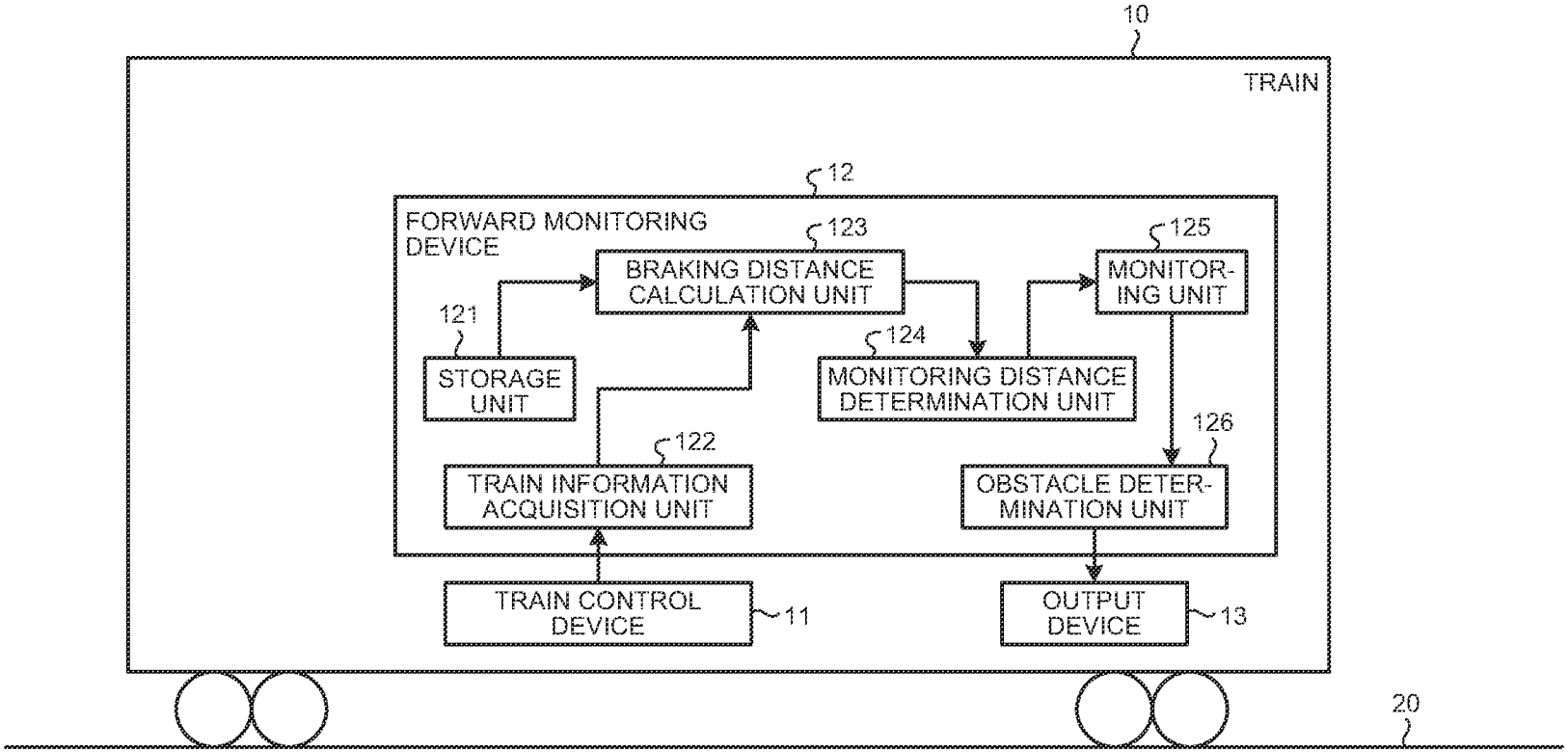
FIG. 1 is a diagram illustrating an example configuration of a forward monitoring device according to a first embodiment.

FIG. 1 is a diagram illustrating an example configuration of a forward monitoring device 12 according to a first embodiment. The forward monitoring device 12 is installed on a train 10. The train 10 monitors whether or not there is an obstacle on a track 20 in the travel direction using the forward monitoring device 12 while running on the track 20. The train 10 includes a train control device 11, the forward monitoring device 12, and an output device 13. The forward monitoring device 12 is connected to the train control device 11 and the output device 13. The forward monitoring device 12 includes a storage unit 121, a train information acquisition unit 122, a braking distance calculation unit 123, a monitoring distance determination unit 124, a monitoring unit 125, and an obstacle determination unit 126.

The train control device 11 detects the location and the speed of the train 10 using devices such as a ground coil (not illustrated) installed on the ground, and an on-board antenna and a tachogenerator (both not illustrated) installed on the train 10. The train control device 11 outputs train location information representing the detected location of the train 10 and train speed information representing the detected speed of the train 10 to the forward monitoring device 12. The method of detecting the location of the train 10 in the train control device 11 is a common method as is conventionally done.

The storage unit 121 stores map information representing location information and a track geometry such as the inclination and presence or absence of a curve, of the track 20 on which the train 10 is to run. The map information may be represented in kilometrage from the point of origin, may be represented in latitude and longitude, may be represented in a set of coordinates based on a point cloud obtained by three-dimensional measurement, or may be represented in their combinational manner. The storage unit 121 also stores brake performance information representing the performance of a brake system (not illustrated) installed on the train 10. The brake performance information is, for example, information that represents the time from when the brake system of the train 10 receives a brake command until the brake system actually applies brakes, that is, until the brake system provides control to decelerate or stop the train, which includes acceleration representing how fast the train decelerates at the time of brake output, and the like.

The train information acquisition unit 122 acquires the train location information representing the location of the train 10 and the train speed information representing the speed of the train 10 from the train control device 11. The train information acquisition unit 122 outputs the acquired train location information and train speed information of the train 10 to the braking distance calculation unit 123.

The braking distance calculation unit 123 acquires the map information and the brake performance information from the storage unit 121. In addition, the braking distance calculation unit 123 acquires the train location information and the train speed information of the train 10 from the train information acquisition unit 122. The braking distance calculation unit 123 calculates the braking distance of the train 10 using the map information, the brake performance information, the train location information, the train speed information, the processing time required for the forward monitoring device 12 to determine the presence or absence of an obstacle, and the reaction time that elapses before the brakes are applied. The processing time is, specifically, a time defined as the time from when the monitoring unit 125 performs monitoring until the obstacle determination unit 126 determines the presence or absence of an obstacle in the forward monitoring device 12. The reaction time is, specifically, a time defined as the time from when information indicating that an obstacle has been detected is outputted from the output device 13 until a train operator actually applies brakes in the train 10, that is, until the operator of the train 10 outputs a brake command to the brake system. It is assumed here that the brake system installed on the train 10 is not an automatic brake system. The automatic brake system said herein refers to a brake system that has a function of automatically outputting a brake in accordance with output results from the forward monitoring device 12. The processing time and the reaction time may be stored in advance in the braking distance calculation unit 123 based on, for example, design values, measured values, and/or the like, by a manufacturer of the forward monitoring device 12, or may be stored in advance in the braking distance calculation unit 123 based on measured values by a railway company that operates the train 10. Note that the processing time and the reaction time may be stored in the storage unit 121, and read from the storage unit 121 by the braking distance calculation unit 123. The braking distance calculation unit 123 outputs the braking distance obtained by the calculation to the monitoring distance determination unit 124.

The monitoring distance determination unit 124 determines the monitoring distance based on the braking distance acquired from the braking distance calculation unit 123. The monitoring distance is a distance on the track 20 from the train 10 in the travel direction of the train 10. In the present embodiment, the monitoring distance determination unit 124 uses the braking distance calculated by the braking distance calculation unit 123 as the monitoring distance. The monitoring distance determination unit 124 sets a monitoring range in which the monitoring unit 125 performs monitoring, on the basis of the monitoring distance. The monitoring range is a range represented in, for example, a distance defined in the front-back direction from the monitoring distance on the track 20, and a distance defined in the left-right direction from the monitoring distance with respect to the travel direction of the train 10. The monitoring distance determination unit 124 outputs the monitoring range that has been set, to the monitoring unit 125.

The monitoring unit 125 monitors an upside of the track 20 in the travel direction of the train 10. Specifically, the monitoring unit 125 monitors an obstacle in the monitoring range that has been set by the monitoring distance determination unit 124 and acquired from the monitoring distance determination unit 124. The monitoring unit 125 is a device capable of detecting an obstacle in the monitoring range, and is, for example, a stereo camera equipped with two or more cameras, a light detection and ranging (LIDAR) apparatus, a radio detection and ranging (RADAR) apparatus, or the like. The monitoring unit 125 may be configured to include two or more devices. Note that the specific configuration of the monitoring unit 125 is not necessarily limited to these examples. The monitoring unit 125 generates a distance image from data obtained by monitoring the monitoring range, and outputs the generated distance image to the obstacle determination unit 126. The distance image is a monitoring result obtained by the monitoring unit 125 monitoring an area surrounding the train 10, and includes one or both of a two-dimensional image and a three-dimensional image including distance information. The monitoring unit 125 is installed on a lead vehicle of the train 10. When the train 10 has a formation of multiple vehicles, a lead vehicle alternates depending on the travel direction, and therefore, the monitoring unit 125 is installed on each of the vehicles at both ends. For example, when the train 10 has a ten-car formation composed of vehicle No. 1 to vehicle No. 10, either vehicle No. 1 or vehicle No. 10 becomes a lead vehicle depending on the travel direction. In this case, the monitoring unit 125 is installed on each of the vehicle No. 1 and the vehicle No. 10 of the train 10. The forward monitoring device 12 uses the monitoring unit 125 installed on the lead vehicle in the travel direction of the train 10.

The obstacle determination unit 126 determines the presence or absence of an obstacle on the track 20 based on the monitoring result of the monitoring unit 125. Specifically, the obstacle determination unit 126 determines the presence or absence of an obstacle in the travel direction of the train 10 based on the distance image acquired from the monitoring unit 125. When the obstacle determination unit 126 determines that the distance image includes an image of an obstacle, the obstacle determination unit 126 generates obstacle information that is information indicating that an obstacle has been detected, and outputs the generated obstacle information to the output device 13. The obstacle information may be information only indicating that an obstacle has been detected, or may include information such as a location and/or an image where the obstacle has been detected.

When the obstacle information is acquired from the obstacle determination unit 126, the output device 13 outputs information indicating that an obstacle has been detected, to the operator of the train 10 and the like. The output device 13 may show that an obstacle has been detected, to the operator of the train 10 and the like with use of a monitor or the like, or may announce that an obstacle has been detected, by voice through a loudspeaker or the like. In addition, when the brake system installed on the train 10 is an automatic brake system, the output device 13 outputs a brake command to the automatic brake system.

Figure 2:
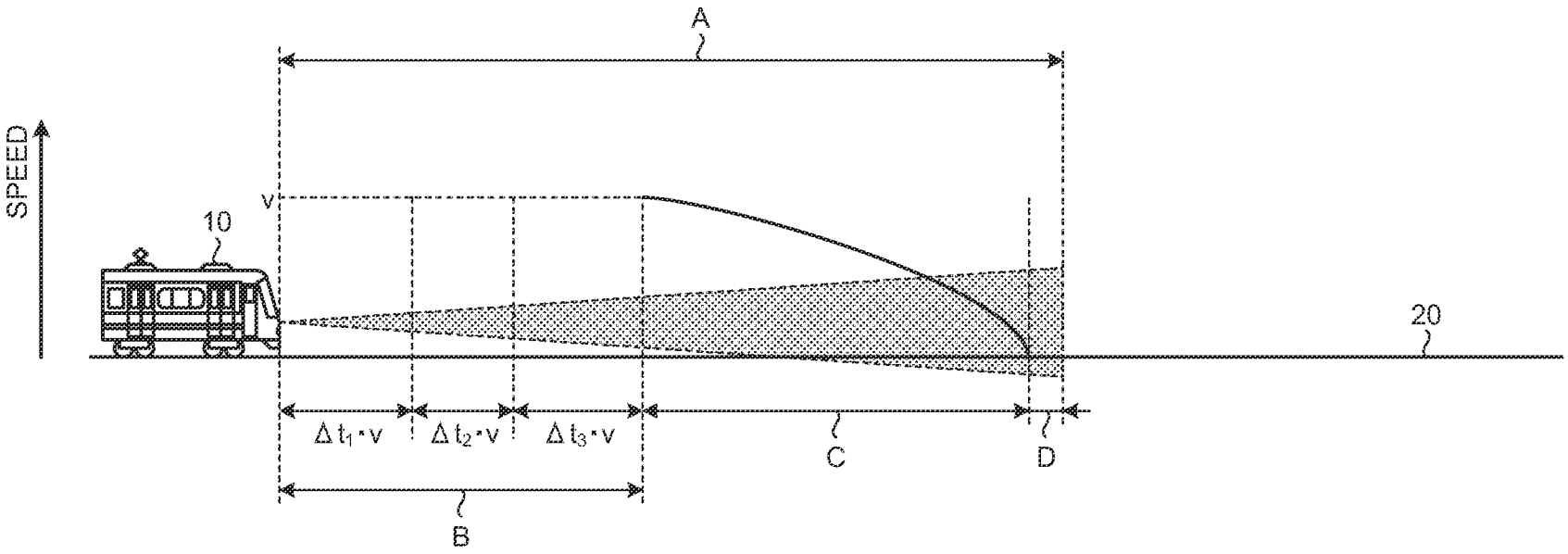
FIG. 2 is a first diagram illustrating an overview of a braking distance calculated by the forward monitoring device according to the first embodiment.

An operation of the forward monitoring device 12 will next be described. FIG. 2 is a first diagram illustrating an overview of a braking distance A calculated by the forward monitoring device 12 according to the first embodiment. FIG. 2 illustrates a transition of the speed of the train 10 running on the track 20. In FIG. 2, v is the speed at the time when the train 10 calculated the braking distance A. In addition, in FIG. 2, the travel direction of the train 10 is a direction from left to right of FIG. 2. As illustrated in FIG. 2, the braking distance A is the sum of an idle running distance B, a decelerated running distance C, and a marginal distance D.

The idle running distance B consists of a first idle running distance $\Delta t_1 \cdot v$, a second idle running distance $\Delta t_2 \cdot v$, and a third idle running distance $\Delta t_3 \cdot v$. The first idle running distance $\Delta t_1 \cdot v$ is a distance for which the train 10 travels during the processing time that is a time $\Delta t_1$ from when the monitoring unit 125 performs monitoring until the obstacle determination unit 126 determines the presence or absence of an obstacle in the forward monitoring device 12. The second idle running distance $\Delta t_2 \cdot v$ is a distance for which the train 10 travels during the reaction time that is a time $\Delta t_2$ from when information indicating that an obstacle has been detected is outputted from the output device 13 in the forward monitoring device 12 until the operator of the train 10 actually applies brakes. The third idle running distance $\Delta t_3 \cdot v$ is a distance for which the train 10 travels during a time $\Delta t_3$ from when the brake system of the train 10 acquires a brake command until the brake system provides control to actually apply brakes, that is, during a time $\Delta t_3$ indicated by the brake performance information.

The decelerated running distance C is a distance for which the train 10 travels during a time from when the train 10 starts deceleration by application of braking until the train 10 actually stops. The decelerated running distance C is calculated based on a factor or factors, for example, deceleration at the time of braking, air resistance, effect of inclination, and/or the like. These factors may be precisely calculated or calculated while adding an allowance to the factors on the safe side. The marginal distance D is a distance obtained with taking into account some measurement error of the monitoring unit 125, idling and slipping, and/or the like. The marginal distance D may be a fixed value or a variable value that varies with the speed of the train 10. The braking distance calculation unit 123 may store in advance information on the marginal distance D, or may obtain the information on the marginal distance D by calculation from the speed v of the train 10 in the case where the distance D is a variable value.

In the forward monitoring device 12, the braking distance calculation unit 123 can improve accuracy in calculation of the braking distance A by summing the idle running distance B, the decelerated running distance C, and the marginal distance D to obtain the braking distance A as illustrated in FIG. 2. Note that when the brake system provided on the train 10 is an automatic brake system and the output device 13 outputs a brake command to the automatic brake system, the reaction time that is the time $\Delta t_2$ can be considered as zero, and therefore the braking distance calculation unit 123 may set the second idle running distance $\Delta t_2 \cdot v$ to 0. That is, the braking distance calculation unit 123 may calculate the braking distance A without using the reaction time that elapses before the brakes are applied. The braking distance A in the case where the brake system provided on the train 10 is an automatic brake system is equal to the sum of the first idle running distance $\Delta t_1 \cdot v$, the third idle running distance $\Delta t_3 \cdot v$, the decelerated running distance C, and the marginal distance D. When the brake system provided on the train 10 is an automatic brake system, the braking distance calculation unit 123 calculates the braking distance A of the train 10 using the map information, the brake performance information, the train location information, the train speed information, and the processing time that elapses before the forward monitoring device 12 determines the presence or absence of an obstacle.

Figure 3:
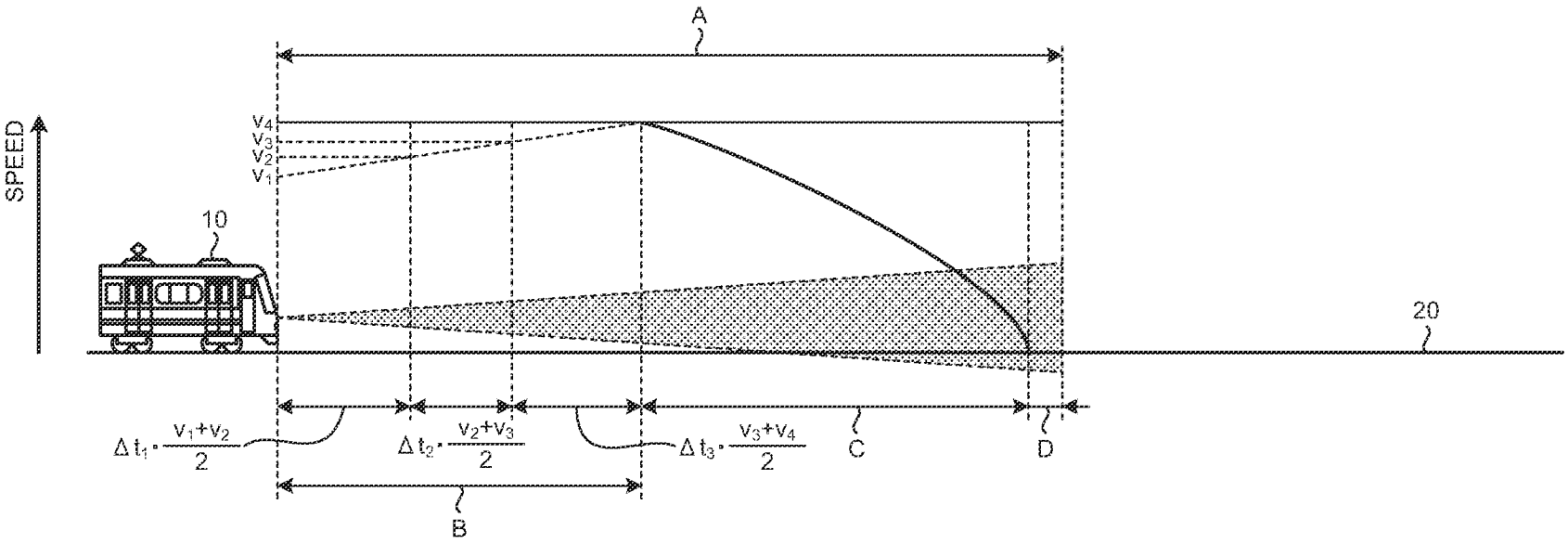
FIG. 3 is a second diagram illustrating an overview of the braking distance calculated by the forward monitoring device according to the first embodiment.

Note that the speed v of the train 10 may be assumed to be in an acceleration speed state as illustrated in FIG. 3 rather than in a constant speed state as illustrated in FIG. 2. FIG. 3 is a second diagram illustrating an overview of the braking distance A calculated by the forward monitoring device 12 according to the first embodiment. FIG. 3 is similar to FIG. 2 except that the speed of the train 10 increases from speed $v_1$ to speed $v_4$ in a section corresponding to the idle running distance B. Note that FIG. 3 gives the first idle running distance as $\Delta t_1 \cdot (v_1+v_2)/2$, the second idle running distance as $\Delta t_2 \cdot (v_2+v_3)/2$, and the third idle running distance as $\Delta t_3 \cdot (v_3+v_4)/2$. In this example, the train acceleration is constant and has a value a, and there are expressed $v_2=v_1+a\Delta t_1$, $v_3=v_2+a\Delta t_2$, and $v_4=v_3+a\Delta t_3$. The forward monitoring device 12 assumes an acceleration condition regardless of the actual running state, thereby making it possible to calculate a more safety-oriented braking distance. Although the acceleration a is assumed to be constant in this example, the forward monitoring device 12 may additionally take into account effects of the train speed, the inclination, the air resistance, and/or the like. In addition, the forward monitoring device 12 may calculate the braking distance with additionally taking into account the running state at the time of start of calculation of a braking distance.

Figure 4:
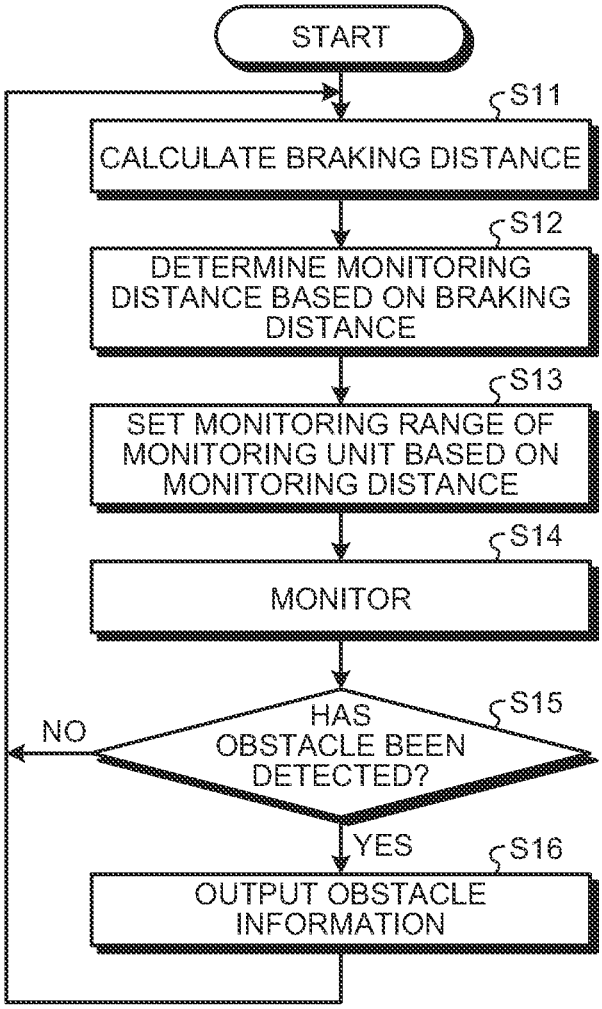
FIG. 4 is a flowchart illustrating an operation of the forward monitoring device according to the first embodiment.

An operation of the forward monitoring device 12 will now be described using a flowchart. FIG. 4 is a flowchart illustrating an operation of the forward monitoring device 12 according to the first embodiment. In the forward monitoring device 12, the braking distance calculation unit 123 acquires the map information and the brake performance information from the storage unit 121, and acquires the train location information and the train speed information of the train 10 from the train information acquisition unit 122. The braking distance calculation unit 123 calculates the braking distance A of the train 10 using the map information, the brake performance information, the train location information, the train speed information, the processing time required for the forward monitoring device 12 to determine the presence or absence of an obstacle, and the reaction time that elapses before the brakes are applied (step S11). The braking distance calculation unit 123 outputs the braking distance A obtained by the calculation to the monitoring distance determination unit 124.

The monitoring distance determination unit 124 determines the monitoring distance based on the braking distance A acquired from the braking distance calculation unit 123 (step S12). The monitoring distance determination unit 124 sets the monitoring range of the monitoring unit 125 based on the monitoring distance (step S13). The monitoring distance determination unit 124 outputs the monitoring range that has been set, to the monitoring unit 125.

The monitoring unit 125 monitors an obstacle in the monitoring range acquired from the monitoring distance determination unit 124 (step S14). The monitoring unit 125 generates a distance image from data obtained from the monitoring, and outputs the generated distance image to the obstacle determination unit 126 as the monitoring result.

The obstacle determination unit 126 acquires the distance image from the monitoring unit 125, and determines whether or not an obstacle has been detected (step S15). When an obstacle has been detected (step S15: Yes), the obstacle determination unit 126 outputs obstacle information to the output device 13 (step S16). The forward monitoring device 12 returns in process to step S11, and repeats the foregoing operation. When no obstacle has been detected (step S15: No), the forward monitoring device 12 returns in process to step S11, and repeats the foregoing operation.

Note that for the forward monitoring device 12, some cases are contemplated in which time needed for the obstacle determination unit 126 to determine that a detected object is an obstacle is wanted to be longer if the object is an animal such as a bird that can quickly move away in the determination about an obstacle, in order to avoid any unnecessary braking operations. The case in which the time needed is wanted to be longer is a case in which accuracy of determination is desired to be improved by the obstacle determination unit 126, for example, with use of multiple distance images obtained through multiple monitoring operations from the monitoring unit 125. An unnecessary braking operation may impair ride comfort of passengers of the train 10. In addition, an unnecessary braking operation may delay arrival at the next station. Meanwhile, the forward monitoring device 12 is preferably configured to avoid a delayed braking operation if a suspicious object is actually an obstacle. A delayed braking operation may cause the train 10 to hit the obstacle. For these reasons, when the obstacle determination unit 126 detects an object that may be regarded as a candidate for an obstacle in the monitoring result of the monitoring unit 125 and determines that a determination needs to be made regarding the presence or absence of an obstacle based on multiple monitoring results, the obstacle determination unit 126 may output obstacle information to the output device 13 so that control is performed on the brake system to apply an initial pressure to the brake system, to inhibit power running, or to make weakened braking in order to shorten the time $\Delta t_3$ from the time of issuance of a brake command for necessity to actually output a brake thereafter until a brake is actually outputted. This enables the forward monitoring device 12 to avoid an unnecessary braking operation, and at the same time to avoid an unsatisfactorily delayed braking operation when a suspicious object is actually an obstacle. That is, the forward monitoring device 12 can avoid impairment of ride comfort of passengers of the train 10, and can avoid a situation in which the train 10 comes in contact with an obstacle while avoiding a situation of delayed arrival at the next station.

A hardware configuration of the forward monitoring device 12 will next be described. In the forward monitoring device 12, the storage unit 121 is a memory. The monitoring unit 125 is a sensor such as a stereo camera or a LIDAR apparatus. The train information acquisition unit 122, the braking distance calculation unit 123, the monitoring distance determination unit 124, and the obstacle determination unit 126 are implemented by a processing circuit. The processing circuit may be a processor that executes a program stored in a memory, and the memory, or may be a dedicated hardware set.

Figure 5:
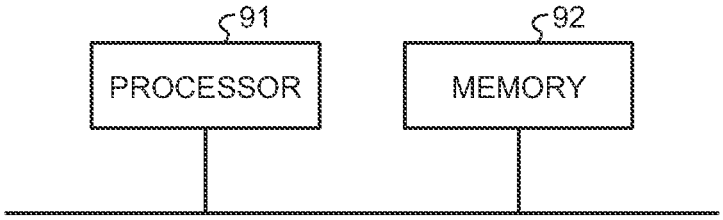
FIG. 5 is a diagram illustrating an example in which a processing circuitry included in the forward monitoring device according to the first embodiment is composed of a processor and a memory.

FIG. 5 is a diagram illustrating an example in which the processing circuit included in the forward monitoring device 12 according to the first embodiment is composed of a processor and a memory. When the processing circuit is composed of a processor 91 and a memory 92, the functionalities of the processing circuit of the forward monitoring device 12 are implemented in software, firmware, or a combination of software and firmware. The software or firmware is described as a program, and is stored in the memory 92. In the processing circuit, each functionality is implemented by an operation in which the processor 91 reads and executes a program stored in the memory 92. That is, the processing circuit has the memory 92 for storing programs by which processes for the forward monitoring device 12 are resultantly curried out. It can also be said that these programs cause a computer to perform a procedure and a method of the forward monitoring device 12.

In this respect, the processor 91 may be a central processing unit (CPU), a processing device, a computing device, a microprocessor, a microcomputer, a digital signal processor (DSP), or the like. In addition, the memory 92 corresponds to, for example, a non-volatile or volatile semiconductor memory such as a random access memory (RAM), a read-only memory (ROM), a flash memory, an erasable programmable ROM (EPROM), or an electrically erasable programmable ROM (EEPROM) (registered trademark); a magnetic disk; a flexible disk; an optical disk; a compact disc; a Mini Disc; a digital versatile disc (DVD); or the like.

Figure 6:
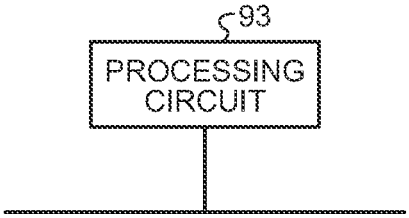
FIG. 6 is a diagram illustrating an example in which the processing circuitry included in the forward monitoring device according to the first embodiment is composed of a dedicated hardware set.

FIG. 6 is a diagram illustrating an example in which the processing circuit included in the forward monitoring device 12 according to the first embodiment is composed of a dedicated hardware set. When the processing circuit is composed of a dedicated hardware set, a processing circuit 93 illustrated in FIG. 6 corresponds to, for example, a single circuit, a composite circuit, a programmed processor, a parallel programmed processor, an application specific integrated circuit (ASIC), a field programmable gate array (FPGA), or a combination thereof. The functionalities of the forward monitoring device 12 may be implemented by the processing circuit 93 on a function-by-function basis, or may be collectively implemented in the processing circuit 93 as a whole.

Note that some of the functionalities of the forward monitoring device 12 may be implemented by a dedicated hardware set and the remainder thereof may be implemented by software or firmware. As just described, the processing circuit can realize the foregoing functionalities in a dedicated hardware set, software, firmware, or a combination thereof.

As described above, according to the present embodiment, the braking distance calculation unit 123 of the forward monitoring device 12 acquires the map information and the brake performance information from the storage unit 121, and acquires the train location information and the train speed information of the train 10 from the train information acquisition unit 122. The braking distance calculation unit 123 calculates the braking distance A of the train 10 using the map information, the brake performance information, the train location information, the train speed information, the processing time required for the forward monitoring device 12 to determine the presence or absence of an obstacle, and the reaction time that elapses before the brakes are applied. The monitoring distance determination unit 124 determines the monitoring distance on the basis of the braking distance A calculated by the braking distance calculation unit 123, and sets the monitoring range of the monitoring unit 125. The braking distance calculation unit 123 can improve accuracy in calculation of the braking distance A by taking into account the idle running distance B. This enables the forward monitoring device 12 to improve accuracy in detection of an obstacle on the periphery of the braking distance A, i.e., in a desired monitoring range. In addition, the forward monitoring device 12 can avoid unnecessary monitoring and reduce the amount of computation in monitoring by virtue of eliminating monitoring of a distant area beyond the monitoring range obtained based on the braking distance A.

Second Embodiment

In a second embodiment, the forward monitoring device determines the monitoring distance further with use of information on a stop limit point of the train.

Figure 7:
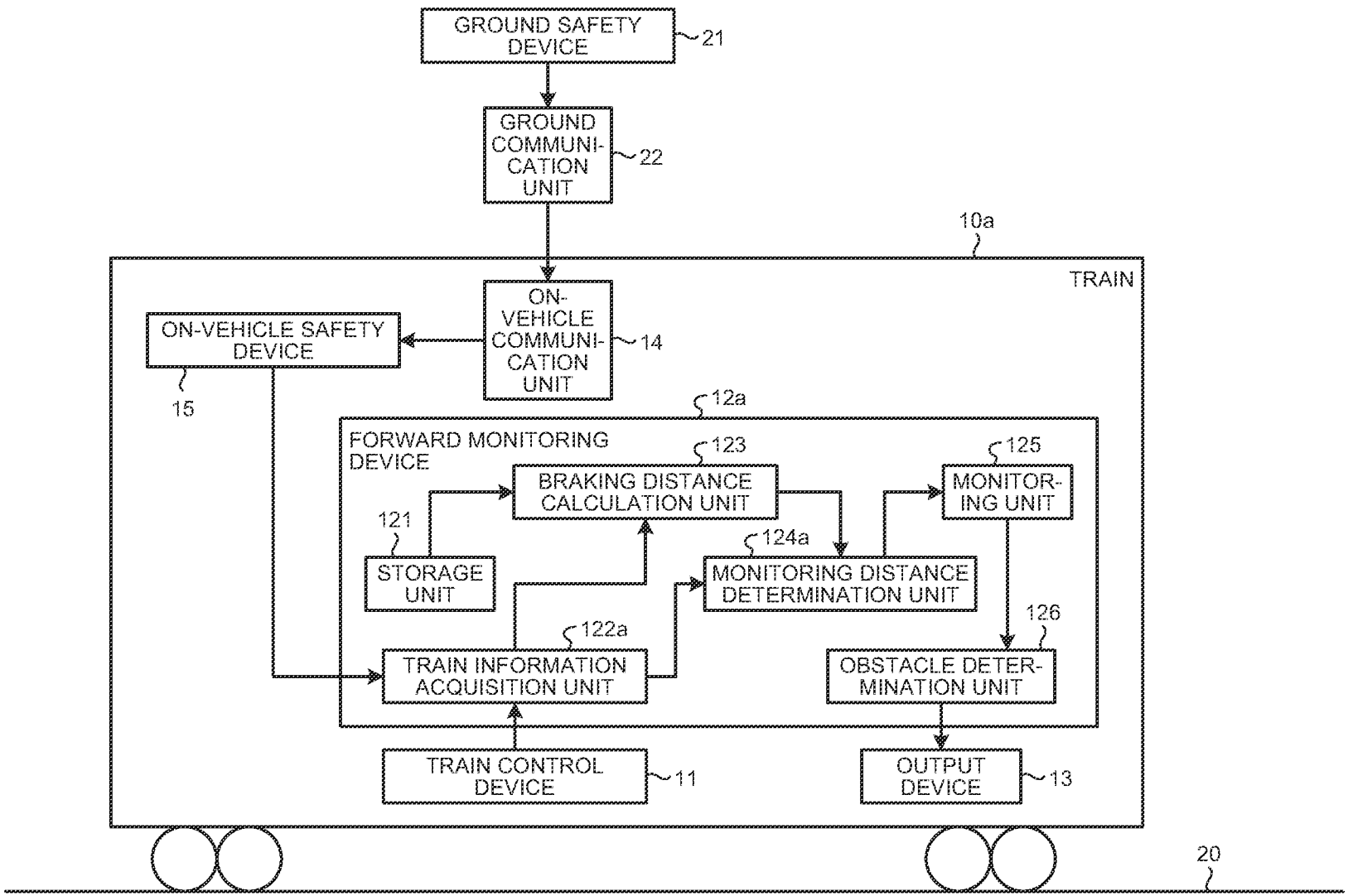
FIG. 7 is a diagram illustrating an example configuration of a forward monitoring device according to a second embodiment.

FIG. 7 is a diagram illustrating an example configuration of a forward monitoring device 12*a* according to the second embodiment. The forward monitoring device 12*a* is installed on a train 10*a*. The train 10*a* monitors whether or not there is an obstacle on the track 20 in the travel direction using the forward monitoring device 12*a* while running on the track 20. The train 10*a* includes the train control device 11, a forward monitoring device 12*a*, the output device 13, an on-vehicle communication unit 14, and an on-vehicle safety device 15. The forward monitoring device 12*a* is connected to the train control device 11, the output device 13, and the on-vehicle safety device 15. In addition, the train 10*a* is connected to a ground safety device 21 via a ground communication unit 22.

The ground safety device 21 collects, from the train 10*a* and other trains (not illustrated), location information of the trains to manage an interval between the train 10*a* and another train. The ground safety device 21 calculates a stop limit point of each of the trains based on the location information of the trains and the like. The ground safety device 21 transmits the stop limit point obtained by the calculation, to each train via the ground communication unit 22. The ground communication unit 22 transmits the stop limit point acquired from the ground safety device 21 to each train by wireless communication. On the train 10*a*, the on-vehicle communication unit 14 receives the stop limit point from the ground safety device 21 via the ground communication unit 22. The on-vehicle communication unit 14 outputs the stop limit point received, to the on-vehicle safety device 15. The on-vehicle safety device 15 outputs the stop limit point acquired from the on-vehicle communication unit 14 to a train information acquisition unit 122*a* of the forward monitoring device 12*a*.

In this operation, when the train 10*a* and the ground safety device 21 constitute a communication based train control (CBTC) system, the ground safety device 21 transmits the stop limit point from the ground communication unit 22 that is a wireless communication device. On the train 10*a*, the on-vehicle communication unit 14 that is a wireless communication device receives the stop limit point. Otherwise, when the train 10*a* and the ground safety device 21 constitute an automatic train control (ATC) system, the ground safety device 21 causes the ground communication unit 22 to transmit the stop limit point via the track 20. On the train 10*a*, the on-vehicle communication unit 14 that is a power receiver receives the stop limit point from the track 20. Still otherwise, when the train 10*a* and the ground safety device 21 constitute a pattern-controlled automatic train stop (ATS-P) system, the ground safety device 21 causes the ground communication unit 22 that is a ground coil to transmit the stop limit point. On the train 10*a*, the on-vehicle communication unit 14 that is an on-board antenna, receives the stop limit point.

A configuration of the forward monitoring device 12*a* will next be described. The forward monitoring device 12*a* includes the train information acquisition unit 122*a* and a monitoring distance determination unit 124*a* in place of the train information acquisition unit 122 and the monitoring distance determination unit 124, respectively, of the forward monitoring device 12 of the first embodiment illustrated in FIG. 1.

The train information acquisition unit 122*a* has a function of acquiring the stop limit point from the on-vehicle safety device 15 installed on the train 10*a* in addition to the function for the train information acquisition unit 122 of the first embodiment. The train information acquisition unit 122*a* outputs the stop limit point acquired from the on-vehicle safety device 15 to the monitoring distance determination unit 124*a*.

The monitoring distance determination unit 124*a* determines the monitoring distance on the basis of the braking distance A acquired from the braking distance calculation unit 123 and the stop limit point acquired from the train information acquisition unit 122*a*. For example, when the location represented by the braking distance A is nearer to the train 10*a* than the location represented by the stop limit point, the monitoring distance determination unit 124*a* determines that the braking distance A is the monitoring distance. When the location represented by the stop limit point is nearer to the train 10*a* than the location represented by the braking distance A, the monitoring distance determination unit 124*a* determines that the distance from the train 10*a* to the location represented by the stop limit point is the monitoring distance.

Figure 8:
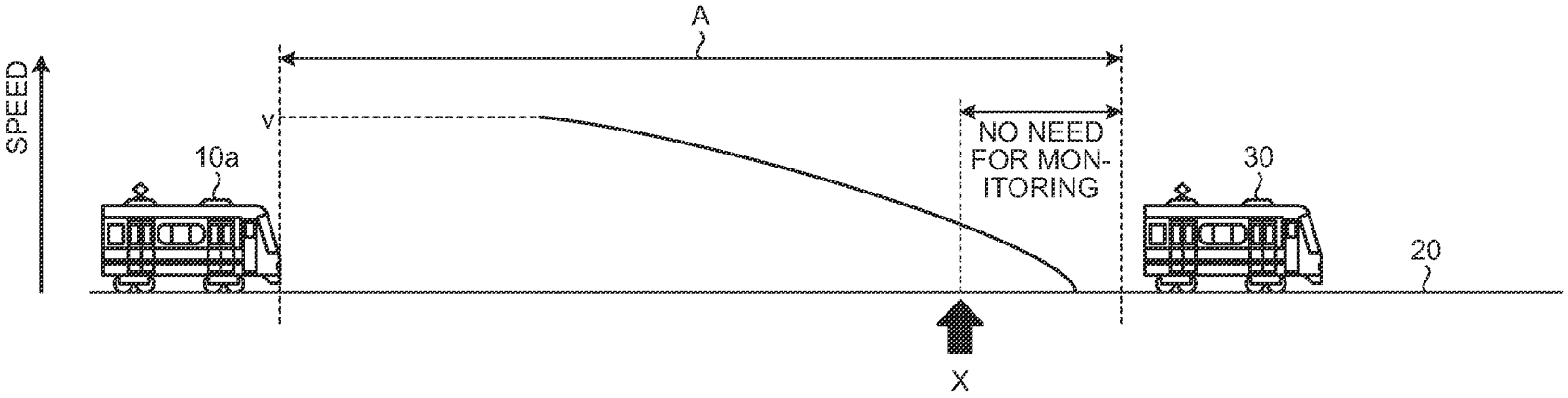
FIG. 8 is a diagram illustrating an example of an operation of the forward monitoring device according to the second embodiment.

An operation of the forward monitoring device 12*a* will next be described. FIG. 8 is a diagram illustrating an example of an operation of the forward monitoring device 12*a* according to the second embodiment. In FIG. 8, X represents the stop limit point. When the forward monitoring device 12*a* calculates the braking distance A with taking into account the idle running distance B as illustrated in FIG. 2 of the first embodiment, it may be contemplated that the location represented by the braking distance A is more distant from the train 10*a* than the stop limit point X. However, the train 10*a* needs to stop before the stop limit point X calculated by the ground safety device 21 based on the location relationship between the train 10*a* and another train 30. In this case, the train 10*a* will not run in practice in a portion of the braking distance A distant from the stop limit point X. Therefore, when the stop limit point X is nearer to the train 10*a* than the location represented by the braking distance A, the monitoring distance determination unit 124*a* determines, as described above, that the distance to the stop limit point X is the monitoring distance.

Figure 9:
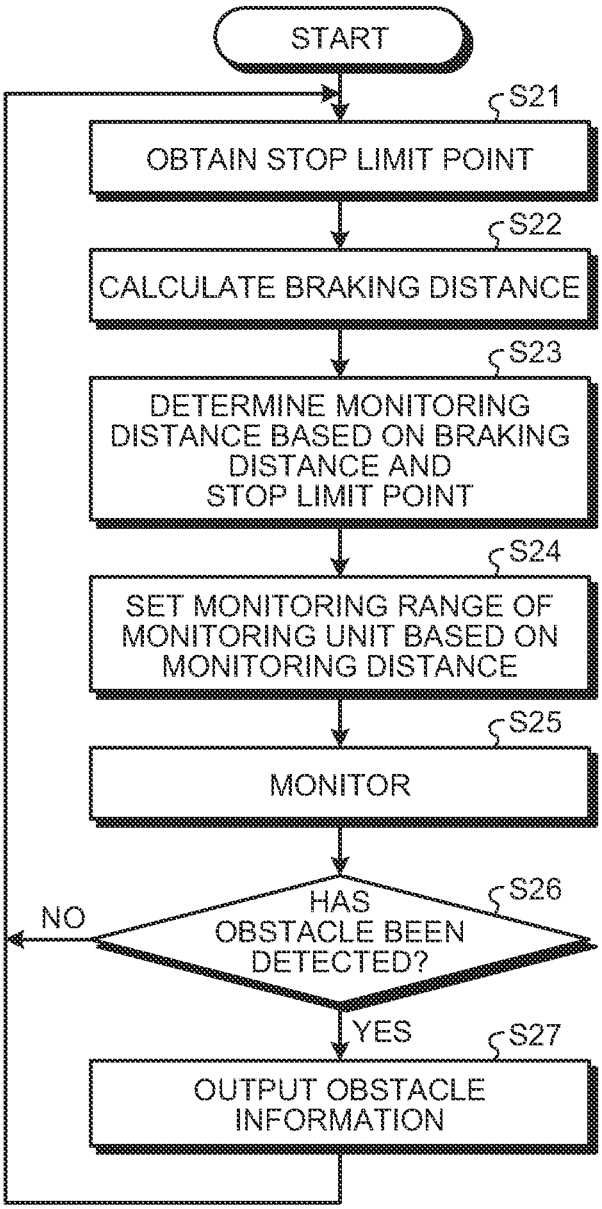
FIG. 9 is a flowchart illustrating an operation of the forward monitoring device according to the second embodiment.

An operation of the forward monitoring device 12*a* will now be described using a flowchart. FIG. 9 is a flowchart illustrating an operation of the forward monitoring device 12*a* according to the second embodiment. In the forward monitoring device 12*a*, the train information acquisition unit 122*a* acquires the stop limit point X from the on-vehicle safety device 15 (step S21). The train information acquisition unit 122*a* outputs the stop limit point X obtained, to the monitoring distance determination unit 124*a*.

The braking distance calculation unit 123 acquires the map information and the brake performance information from the storage unit 121, and acquires the train location information and the train speed information of the train 10*a* from the train information acquisition unit 122*a*. The braking distance calculation unit 123 calculates the braking distance A of the train 10*a* using the map information, the brake performance information, the train location information, the train speed information, the processing time required for the forward monitoring device 12*a* to determine the presence or absence of an obstacle, and the reaction time that elapses before the brakes are applied (step S22). The braking distance calculation unit 123 outputs the braking distance A obtained by the calculation to the monitoring distance determination unit 124*a*.

The monitoring distance determination unit 124*a* acquires the braking distance A from the braking distance calculation unit 123, and acquires the stop limit point X from the train information acquisition unit 122*a*. The monitoring distance determination unit 124*a* determines the monitoring distance of the monitoring unit 125 based on the braking distance A and the stop limit point X (step S23). The monitoring distance determination unit 124*a* sets the monitoring range of the monitoring unit 125 based on the monitoring distance (step S24). The monitoring distance determination unit 124*a* outputs the monitoring range that has been set, to the monitoring unit 125.

The monitoring unit 125 monitors an obstacle in the monitoring range acquired from the monitoring distance determination unit 124*a* (step S25). The monitoring unit 125 generates a distance image from data obtained by the monitoring, and outputs the distance image generated, to the obstacle determination unit 126.

The obstacle determination unit 126 acquires the distance image from the monitoring unit 125, and determines whether or not an obstacle has been detected (step S26). When an obstacle has been detected (step S26: Yes), the obstacle determination unit 126 outputs obstacle information to the output device 13 (step S27). Then, the forward monitoring device 12*a* returns in process to step S21, and repeats the foregoing operation. When no obstacle has been detected (step S26: No), the forward monitoring device 12*a* returns in process to step S21, and repeats the foregoing operation.

As described above, according to the present embodiment, the monitoring distance determination unit 124*a* of the forward monitoring device 12*a* determines the monitoring distance based on the braking distance A and the stop limit point X to set the monitoring range. This enables the forward monitoring device 12*a* to further improve accuracy in detection of an obstacle on a periphery of the braking distance A, i.e., in a desired monitoring range, as compared to the first embodiment. In addition, the forward monitoring device 12*a* can avoid unnecessary monitoring and further reduce the amount of computation in monitoring as compared to the first embodiment, by virtue of eliminating monitoring of a more distant area beyond the monitoring range based on the braking distance A and the stop limit point X.

Third Embodiment

In a third embodiment, the forward monitoring device determines the monitoring distance additionally with use of information of an in-station stop location of the train or information of a remaining running distance to a stop location such as a station.

Figure 10:
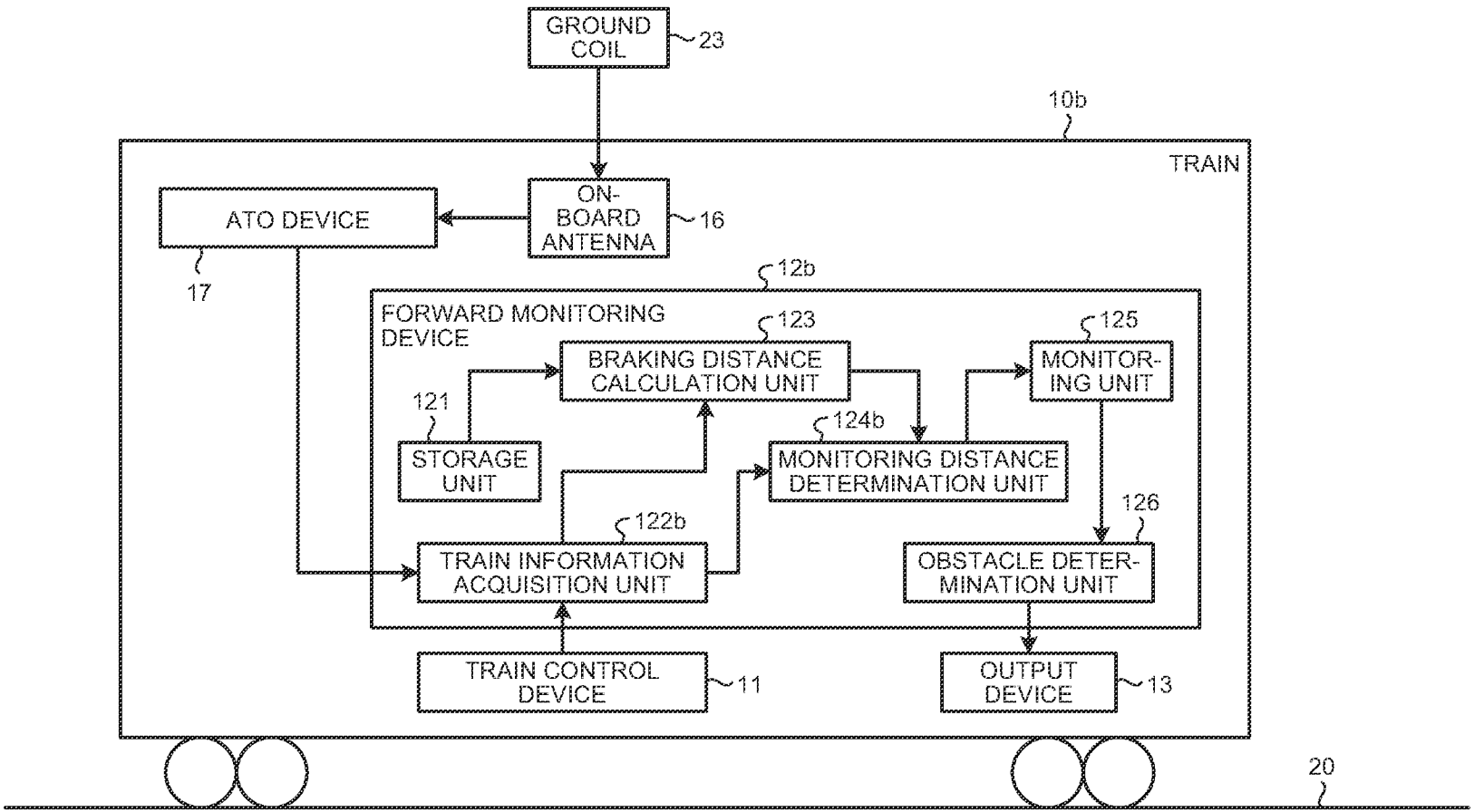
FIG. 10 is a diagram illustrating an example configuration of a forward monitoring device according to a third embodiment.

FIG. 10 is a diagram illustrating an example configuration of a forward monitoring device 12*b* according to the third embodiment. The forward monitoring device 12*b* is installed on a train 10*b*. The train 10*b* monitors whether or not there is an obstacle on the track 20 in the travel direction using the forward monitoring device 12*b* while running on the track 20. The train 10*b* includes the train control device 11, the forward monitoring device 12*b*, the output device 13, an on-board antenna 16, and an automatic train operation (ATO) device 17. The forward monitoring device 12*b* is connected to the train control device 11, the output device 13, and the ATO device 17. In addition, the train 10*b* is connected to a ground coil 23.

The ground coil 23 transmits the in-station stop location or the remaining running distance to a stop location such as a station, to the train 10*b* by wireless communication. The in-station stop location is a location where the train 10*b* stops upon arrival at a station. The remaining running distance is a remaining distance for which the train 10*b* is to be run before the stop location when the train 10*b* arrives at a station or the like. The on-board antenna 16 receives the in-station stop location or the remaining running distance from the ground coil 23 by wireless communication. The on-board antenna 16 outputs the received in-station stop location or remaining running distance to the ATO device 17. The ATO device 17 that is an automatic train operation device outputs the in-station stop location or remaining running distance acquired from the on-board antenna 16 to a train information acquisition unit 122*b* of the forward monitoring device 12*b*.

A configuration of the forward monitoring device 12*b* will next be described. The forward monitoring device 12*b* includes the train information acquisition unit 122*b* and a monitoring distance determination unit 124*b* in place of the train information acquisition unit 122 and the monitoring distance determination unit 124, respectively, of the forward monitoring device 12 of the first embodiment illustrated in FIG. 1.

The train information acquisition unit 122*b* has a function of acquiring the in-station stop location or the remaining running distance from the ATO device 17 installed on the train 10*b* in addition to the function for the train information acquisition unit 122 of the first embodiment. Note that the in-station stop location may be beforehand stored in the storage unit 121, and the train information acquisition unit 122*b* may read the in-station stop location from the storage unit 121. The train information acquisition unit 122*b* outputs the in-station stop location or remaining running distance acquired from the ATO device 17, to the monitoring distance determination unit 124*b*.

The monitoring distance determination unit 124*b* determines the monitoring distance on the basis of the braking distance A acquired from the braking distance calculation unit 123 and the in-station stop location or remaining running distance acquired from the train information acquisition unit 122*b*. For example, when a location represented by the braking distance A is nearer to the train 10*b* than a location represented by the in-station stop location or remaining running distance, the monitoring distance determination unit 124*b* determines that the braking distance A is the monitoring distance. When a location represented by the in-station stop location or remaining running distance is nearer to the train 10*b* than a location represented by the braking distance A, the monitoring distance determination unit 124*b* determines that a distance from the train 10*b* to the location represented by the in-station stop location or remaining running distance is the monitoring distance.

Figure 11:
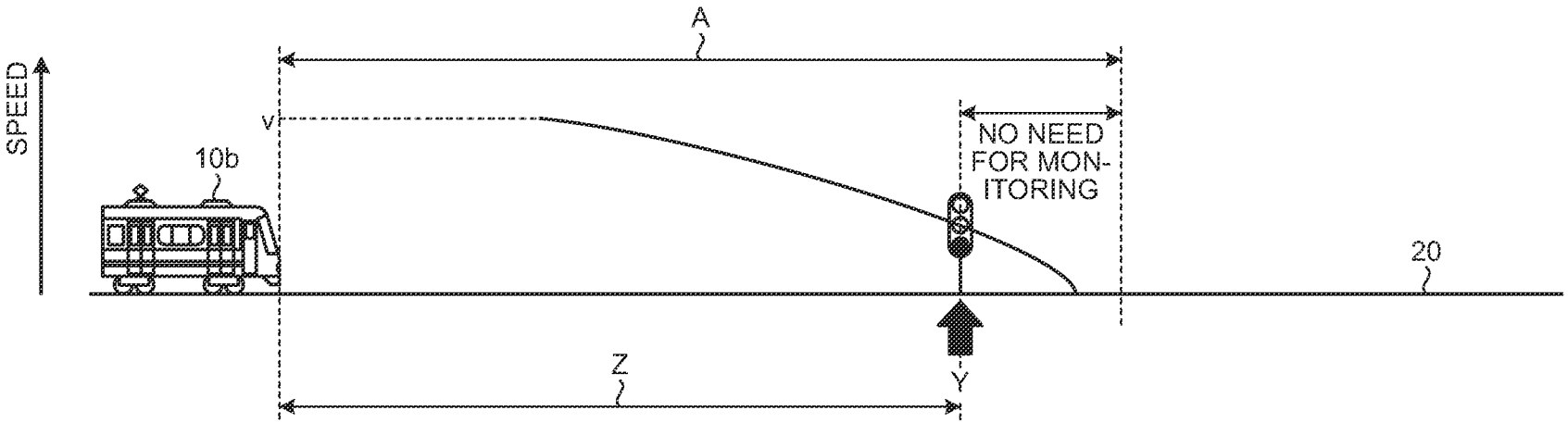
FIG. 11 is a diagram illustrating an example of an operation of the forward monitoring device according to the third embodiment.

An operation of the forward monitoring device 12*b* will next be described. FIG. 11 is a diagram illustrating an example of an operation of the forward monitoring device 12*b* according to the third embodiment. In FIG. 11, Y represents the in-station stop location, and Z represents the remaining running distance. When the forward monitoring device 12*b* calculates the braking distance A with taking into account the idle running distance B as illustrated in FIG. 2 of the first embodiment, it is contemplated that the location represented by the braking distance A is more distant from the train 10*b* than the location represented by the in-station stop location Y or the remaining running distance Z. However, the train 10*b* needs to stop before the location represented by the in-station stop location Y or the remaining running distance Z. In this case, the train 10*b* is practically supposed not to run in the portion of the braking distance A more distant than the location represented by the in-station stop location Y or the remaining running distance Z. For that reason, as described above, when the location represented by the in-station stop location Y or the remaining running distance Z is nearer to the train 10*b* than the location represented by the braking distance A, the monitoring distance determination unit 124*b* determines that the distance to the location represented by the in-station stop location Y or the remaining running distance Z is the monitoring distance.

Figure 12:
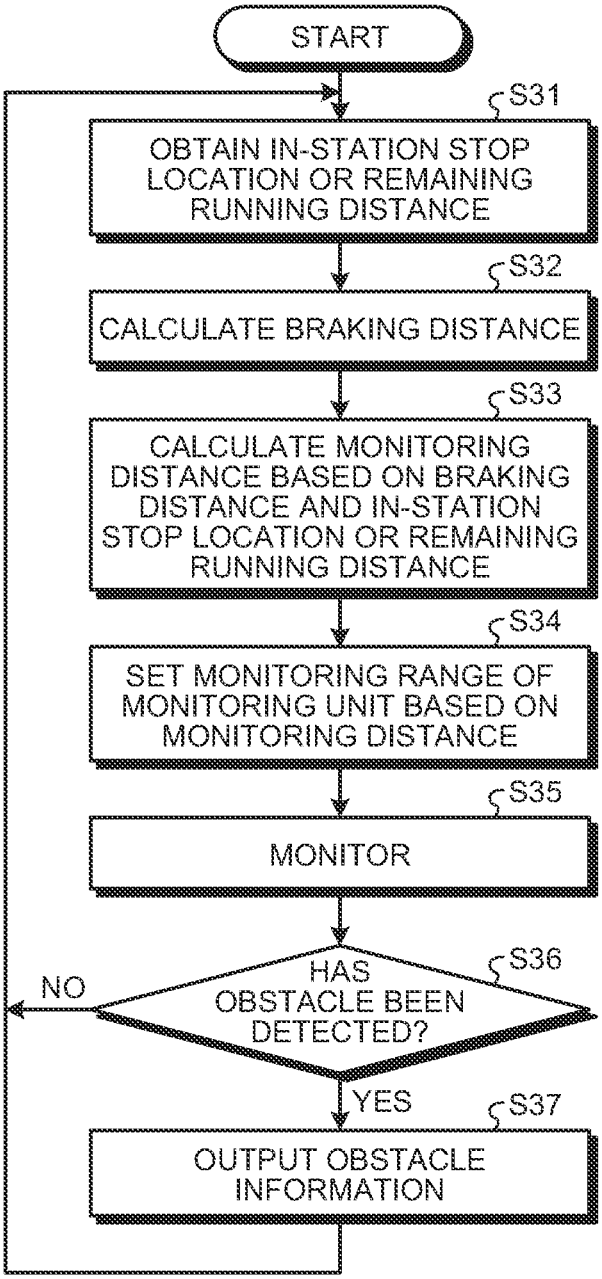
FIG. 12 is a flowchart illustrating an operation of the forward monitoring device according to the third embodiment.

An operation of the forward monitoring device 12*b* will now be described using a flowchart. FIG. 12 is a flowchart illustrating an operation of the forward monitoring device 12*b* according to the third embodiment. In the forward monitoring device 12*b*, the train information acquisition unit 122*b* acquires the in-station stop location Y or the remaining running distance Z from the ATO device 17 (step S31). The train information acquisition unit 122*b* outputs the in-station stop location Y or remaining running distance Z acquired, to the monitoring distance determination unit 124*b*.

The braking distance calculation unit 123 acquires the map information and the brake performance information from the storage unit 121, and acquires the train location information and train speed information of the train 10*b* from the train information acquisition unit 122*b*. The braking distance calculation unit 123 calculates the braking distance A of the train 10*b* using the map information, the brake performance information, the train location information, the train speed information, the processing time required for the forward monitoring device 12*b* to determine the presence or absence of an obstacle, and the reaction time that elapses before the brakes are applied (step S32). The braking distance calculation unit 123 outputs the braking distance A obtained by the calculation to the monitoring distance determination unit 124*b*.

The monitoring distance determination unit 124*b* acquires the braking distance A from the braking distance calculation unit 123, and acquires the in-station stop location Y or the remaining running distance Z from the train information acquisition unit 122*b*. The monitoring distance determination unit 124*b* determines the monitoring distance of the monitoring unit 125 based on the braking distance A and the in-station stop location Y or remaining running distance Z (step S33). The monitoring distance determination unit 124*b* sets the monitoring range of the monitoring unit 125 based on the monitoring distance (step S34). The monitoring distance determination unit 124*b* outputs the monitoring range that has been set, to the monitoring unit 125.

The monitoring unit 125 monitors an obstacle in the monitoring range acquired from the monitoring distance determination unit 124*b* (step S35). The monitoring unit 125 generates a distance image from data obtained by the monitoring, and outputs the distance image generated, to the obstacle determination unit 126.

The obstacle determination unit 126 acquires the distance image from the monitoring unit 125, and determines whether or not an obstacle has been detected (step S36). When an obstacle has been detected (step S36: Yes), the obstacle determination unit 126 outputs obstacle information to the output device 13 (step S37). Then, the forward monitoring device 12*b* returns in process to step S31, and repeats the foregoing operation. When no obstacle has been detected (step S36: No), the forward monitoring device 12*b* returns in process to step S31, and repeats the foregoing operation.

As described above, according to the present embodiment, the monitoring distance determination unit 124*b* of the forward monitoring device 12*b* is configured to determine the monitoring distance based on the braking distance A and the in-station stop location Y or remaining running distance Z to set the monitoring range. By so doing, the forward monitoring device 12*b* can further improve accuracy in detection of an obstacle on the periphery of the braking distance A, i.e., in a desired monitoring range, as compared to the first embodiment. In addition, the forward monitoring device 12*b* can avoid unnecessary monitoring and further reduce the amount of computation in monitoring as compared to the first embodiment, by virtue of eliminating monitoring of a more distant area beyond the monitoring range that is based on the braking distance A and the in-station stop location Y or remaining running distance Z.

The configurations described in the foregoing embodiments are illustrated as just examples. These configurations may be each combined with other publicly known techniques, and the embodiments may be combined to each other. Moreover, each of the configurations may be partially omitted and/or modified without departing from the scope of the present disclosure.

REFERENCE SIGNS LIST

10, 10*a*, 10*b* train; 11 train control device; 12, 12*a*, 12*b* forward monitoring device; 13 output device; 14 on-vehicle communication unit; 15 on-vehicle safety device; 16 on-board antenna; 17 ATO device; 20 track; 21 ground safety device; 22 ground communication unit; 23 ground coil; 30 another train; 121 storage unit; 122, 122*a*, 122*b* train information acquisition unit; 123 braking distance calculation unit; 124, 124*a*, 124*b* monitoring distance determination unit; 125 monitoring unit; 126 obstacle determination unit; A braking distance; B idle running distance; C decelerated running distance; D marginal distance; X stop limit point; Y in-station stop location; Z remaining running distance.

The invention claimed is:

1. A forward monitoring device to be installed on a train, the forward monitoring device comprising:

a storage unit to store map information and brake performance information, the map information representing location information and a track geometry of a track on which the train is to run, the brake performance information representing performance of a brake system installed on the train;

a train information acquisition unit to acquire train location information and train speed information of the train;

a monitoring unit to monitor an upside of the track in a travel direction of the train;

an obstacle determination unit to determine presence or absence of an obstacle on the track based on a monitoring result of the monitoring unit;

a braking distance calculation unit to calculate a braking distance of the train using the map information, the brake performance information, the train location information, the train speed information, and a processing time from when the monitoring unit performs monitoring until the obstacle determination unit determines presence or absence of an obstacle; and a monitoring distance determination unit to determine a monitoring distance based on the braking distance to set a monitoring range of the monitoring unit.

2. The forward monitoring device according to claim 1, wherein the train information acquisition unit acquires a stop limit point of the train from an on-vehicle safety device installed on the train, and the monitoring distance determination unit determines the monitoring distance based on the braking distance and on the stop limit point.

3. The forward monitoring device according to claim 2, wherein when a location represented by the stop limit point is nearer to the train than a location represented by the braking distance, the monitoring distance determination unit determines that a distance from the train to the location represented by the stop limit point is the monitoring distance.

4. The forward monitoring device according to claim 1, wherein the train information acquisition unit acquires, from an automatic train operation device installed on the train, information of an in-station stop location of the train or information of a remaining running distance representing a distance to the in-station stop location, and the monitoring distance determination unit determines the monitoring distance of the monitoring unit based on the braking distance and the in-station stop location or the remaining running distance.

5. The forward monitoring device according to claim 4, wherein when a location represented by the in-station stop location or the remaining running distance is nearer to the train than a location represented by the braking distance, the monitoring distance determination unit determines that a distance from the train to the location represented by the in-station stop location or the remaining running distance is the monitoring distance.

6. The forward monitoring device according to claim 1, wherein when the brake system is not an automatic brake system, the braking distance calculation unit calculates the braking distance with additional use of information of a predetermined reaction time that elapses before an operator of the train outputs a brake command to the brake system.

7. The forward monitoring device according to claim 1, wherein the monitoring unit performs monitoring in the monitoring range that has been set by the monitoring distance determination unit.

8. The forward monitoring device according to claim 1, wherein when the obstacle determination unit detects an object that is regarded as a candidate for the obstacle in the monitoring result and determines that a determination on presence or absence of the obstacle based on multiple monitoring results is required to be made, the obstacle determination unit provides control to apply an initial pressure to the brake system, or provides control to inhibit power running.

9. The forward monitoring device according to claim 1, wherein a speed of the train represented by the train speed information is in a constant speed state or an accelerated speed state at a time when the braking distance calculation unit calculates the braking distance of the train.

10. A forward monitoring method in a forward monitoring device to be installed on a train, the forward monitoring method comprising:

a train information acquisition step of, by a train information acquisition unit, acquiring train location information and train speed information of the train;

a monitoring step of, by a monitoring unit, monitoring an upside of a track in a travel direction of the train;

an obstacle determination step of, by an obstacle determination unit, determining presence or absence of an obstacle on the track based on a monitoring result of the monitoring unit;

a braking distance calculation step of, by a braking distance calculation unit, calculating a braking distance of the train using map information, brake performance information, the train location information, the train speed information, and a processing time from when the monitoring unit performs monitoring until the obstacle determination unit determines presence or absence of an obstacle, the map information representing location information and a track geometry of the track on which the train is to run, the brake performance information representing performance of a brake system installed on the train; and a monitoring distance determination step of, by a monitoring distance determination unit, determining a monitoring distance based on the braking distance to set a monitoring range of the monitoring unit.

11. The forward monitoring method according to claim 10, wherein in the train information acquisition step, the train information acquisition unit acquires a stop limit point of the train from an on-vehicle safety device installed on the train, and in the monitoring distance determination step, the monitoring distance determination unit determines the monitoring distance based on the braking distance and the stop limit point.

12. The forward monitoring method according to claim 11, wherein in the monitoring distance determination step, when a location represented by the stop limit point is nearer to the train than a location represented by the braking distance, the monitoring distance determination unit determines that a distance from the train to the location represented by the stop limit point is the monitoring distance.

13. The forward monitoring method according to claim 10, wherein in the train information acquisition step, the train information acquisition unit acquires, from an automatic train operation device installed on the train, information of an in-station stop location of the train, or information of a remaining running distance representing a distance to the in-station stop location, and in the monitoring distance determination step, the monitoring distance determination unit determines the monitoring distance of the monitoring unit based on the braking distance and the in-station stop location or the remaining running distance.

14. The forward monitoring method according to claim 13, wherein in the monitoring distance determination step, when a location represented by the in-station stop location or the remaining running distance is nearer to the train than a location represented by the braking distance, the monitoring distance determination unit determines that a distance from the train to the location represented by the in-station stop location or the remaining running distance is the monitoring distance.

15. The forward monitoring method according to claim 10, wherein when the brake system is not an automatic brake system, in the braking distance calculation step, the braking distance calculation unit calculates the braking distance with additional use of information of a predetermined reaction time that elapses before an operator of the train outputs a brake command to the brake system.

16. The forward monitoring method according to claim 10, wherein in the monitoring step, the monitoring unit performs monitoring in the monitoring range that has been set by the monitoring distance determination unit.

17. The forward monitoring method according to claim 10, wherein in the obstacle determination step, when the obstacle determination unit detects an object that is regarded as a candidate for the obstacle in the monitoring result and determines that a determination on presence or absence of the obstacle based on multiple monitoring results is required to be made, the obstacle determination unit provides control to apply an initial pressure to the brake system, or provides control to inhibit power running.

18. The forward monitoring method according to claim 10, wherein a speed of the train represented by the train speed information is in a constant speed state or an accelerated speed state at a time when the braking distance calculation unit calculates the braking distance of the train in the braking distance calculation step.

* * * * *